US008821320B2

(12) United States Patent
Sato

(10) Patent No.: US 8,821,320 B2
(45) **Date of Patent: *Sep. 2, 2014**

(54) GOLF BALL

(75) Inventor: Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 554 days.

This patent is subject to a terminal disclaimer.

(21) Appl. No.: 13/180,832

(22) Filed: Jul. 12, 2011

(65) Prior Publication Data

US 2012/0010026 A1 Jan. 12, 2012

Related U.S. Application Data

(63) Continuation-in-part of application No. 12/249,139, filed on Oct. 10, 2008, now Pat. No. 8,002,647.

(51) Int. Cl.
*A63B 37/12* (2006.01)
*A63B 37/00* (2006.01)

(52) U.S. Cl.
CPC ..... *A63B 37/0004* (2013.01); *A63B 37/0012* (2013.01); *A63B 37/0007* (2013.01); *A63B 37/0017* (2013.01); *A63B 37/0019* (2013.01); *A63B 37/0018* (2013.01); *A63B 37/009* (2013.01); *A63B 37/0089* (2013.01); *A63B 37/0021* (2013.01); *A63B 37/002* (2013.01)
USPC ..... 473/383

(58) Field of Classification Search
USPC ..... 473/383–385
See application file for complete search history.

(56) References Cited

U.S. PATENT DOCUMENTS

| | | | | |
|---|---|---|---|---|
| 7,066,842 | B2 | 6/2006 | Sato et al. | |
| 8,002,647 | B2 * | 8/2011 | Sato | 473/383 |
| 2005/0239579 | A1 * | 10/2005 | Sato et al. | 473/378 |

FOREIGN PATENT DOCUMENTS

| | | | |
|---|---|---|---|
| JP | 11-47310 | A | 2/1999 |
| JP | 2005-305152 | A | 11/2005 |
| JP | 2005-319292 | A | 11/2005 |
| JP | 2006-095281 | A | 4/2006 |
| JP | 2006-116308 | A | 5/2006 |
| JP | 2006-130318 | A | 5/2006 |
| JP | 2006-142012 | A | 6/2006 |
| JP | 2006-181133 | A | 7/2006 |
| JP | 2007-021203 | A | 2/2007 |
| JP | 2007-29744 | A | 2/2007 |
| JP | 2008-012299 | A | 1/2008 |

OTHER PUBLICATIONS

Japanese Office Action issued in Japanese Application No. 2009-235070 dated Feb. 5, 2013.

* cited by examiner

*Primary Examiner* — Raeann Gorden
(74) *Attorney, Agent, or Firm* — Sughrue Mion, PLLC

(57) ABSTRACT

A golf ball includes a plurality of circular dimples formed on the surface thereof, each of the circular dimples having a flat bottom surface; and a plurality of noncircular dimples formed on the surface of the golf ball, at least about 10 percent of dimples of all the dimples on the surface being the noncircular dimples, wherein a boundary line between a land part of the golf ball and the noncircular dimples each comprise a curved line part and a straight line part. The plurality of noncircular dimples each having a flat bottom surface. The bottom surface of the noncircular dimple may has a planar shape approximately similar to the boundary line. The lift coefficient CL at Re 70000/2000 rpm may be at least about 70 percent of the lift coefficient CL at Re 80000/2000 rpm, and the drag coefficient CD at Re 180000/2520 rpm is up to about 0.225.

17 Claims, 4 Drawing Sheets

GOLF BALL

BACKGROUND OF THE INVENTION

The present invention relates to a golf ball and, more particularly, relates to a golf ball having dimples formed on the surface thereof to improve the carry.

In designing a golf ball, it is well known that to obtain a long carry when the golf ball is hit, a high coefficient of restitution inherent in the golf ball itself and low air resistance in the flight time caused by dimples arranged on the surface of golf ball are important. Usually, many dimples are arranged on the surface of a golf ball. To reduce the air resistance, there have been proposed various methods for arranging the dimples on the surface of golf ball at a density that is as high as possible and uniformly.

Japanese Patent Application Publication No. 2006-095281 and Japanese Patent Application Publication No. 2008-12299 describe that by arranging noncircular dimples between circular dimples, the surface occupancy ratio of dimples is increased to improve the aerodynamic performance of a golf ball. Also, Japanese Patent Application Publication No. 2007-21203 describes that the wall surface of a dimple is formed by a plurality of flat surfaces to improve the carry of a ball that has been hit.

However, the shape of the bottom surface of the noncircular dimple described in Japanese Patent Application Publication No. 2006-095281 and Japanese Patent Application Publication No. 2008-12299 is curved so as to deepen toward the center of the dimple. Therefore, although the surface occupancy ratio of dimples can be increased, there is a tendency for the depth of the dimples to increase. For such a shape, since the surface occupancy ratio of dimples is high, the air resistance during flight decreases. However, the lift of the golf ball is excessive in a high-speed region after the ball has been hit, so that there is a tendency for the golf ball to be blown upward, and there is also a tendency for the lift of golf ball to not continue for long in a low-speed region in the latter half of the trajectory. Therefore, a sufficient carry cannot be obtained.

SUMMARY OF THE INVENTION

Accordingly, an object of the present invention is to provide a golf ball configured so that even if the surface occupancy ratio of dimples is increased, the depth of the dimple is kept shallow so as to restrain a lift acting on the golf ball flying in a high-speed region after the ball has been hit, and the lift of the golf ball flying in a low-speed region in the latter half of trajectory is maintained for longer, by which a longer carry can be obtained.

To achieve the above object, the present invention provides a golf ball comprising a plurality of dimples formed on the surface thereof, in which at least about 10% of the dimples among the total dimples on the surface are noncircular dimples in which a boundary line between a land part and the dimple comprises a curved line part and a straight line part, and the noncircular dimples each have a flat bottom surface. Also, circular dimples formed on the surface each have a flat bottom surface.

The bottom surface of the noncircular dimple may preferably have a circular or polygonal planar shape. Also, the bottom surface of the noncircular dimple more preferably may have a planar shape approximately similar to the boundary line. In order for the distance between the bottom surface and the boundary line to be capable of being kept constant, the curved line part and the straight line part in the boundary line of the noncircular dimple may be connected to each other with a part having a smooth curvature.

The surface occupancy ratio of the noncircular dimples to the surface of the golf ball preferably may be at least about 65%. Also, at least about fifty noncircular dimples preferably may be formed. For the golf ball in accordance with the present invention, the lift coefficient CL at Re 70000/2000 rpm preferably may be at least about 70% of the lift coefficient CL at Re 80000/2000 rpm, and the drag coefficient CD at Re180000/2520 rpm preferably may be up to about 0.225.

Thus, according to the present invention, at least about 10% of the dimples among the total dimples formed on the golf ball are made noncircular dimples in which a boundary line between a land part and the dimple comprises a curved line part and a straight line part, and the bottom surfaces of the noncircular dimples are made flat. The bottom surfaces of circular dimples are also made flat. Thereby, the dimples are formed so as to be shallow. Therefore, even if the surface occupancy ratio of dimples is high, a proper total volume of dimples can be maintained. Thereby, a lift that is acting on the golf ball flying in a high-speed region after the ball has been hit is restrained, and blowing upward can be prevented. Also, the lift of the golf ball flying in a low-speed region in the latter half of trajectory is maintained for longer, and the flight duration can be increased, by which the carry can be improved.

DESCRIPTION OF THE PREFERRED EMBODIMENTS

Figure 1:
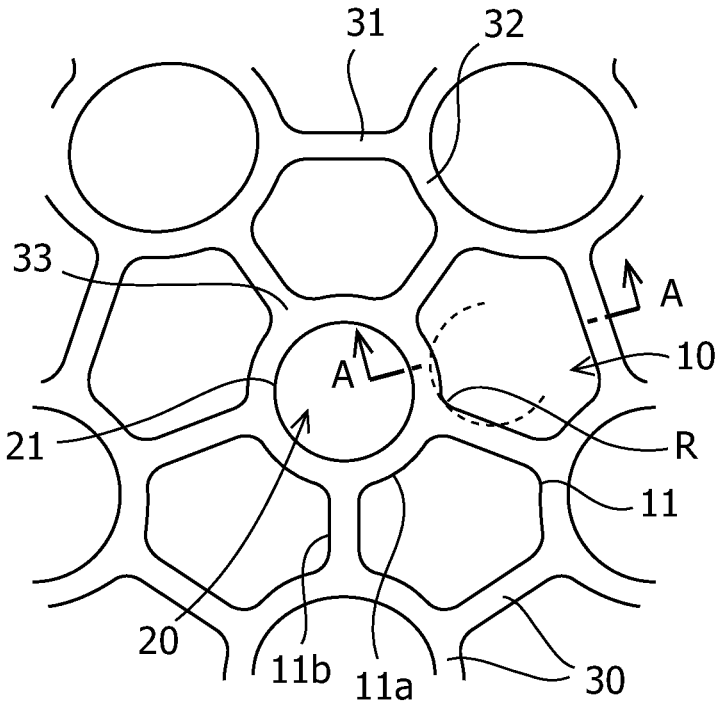
FIG. 1 is an enlarged plan view showing the surface of a golf ball in accordance with one embodiment of the present invention.
Figure 2:
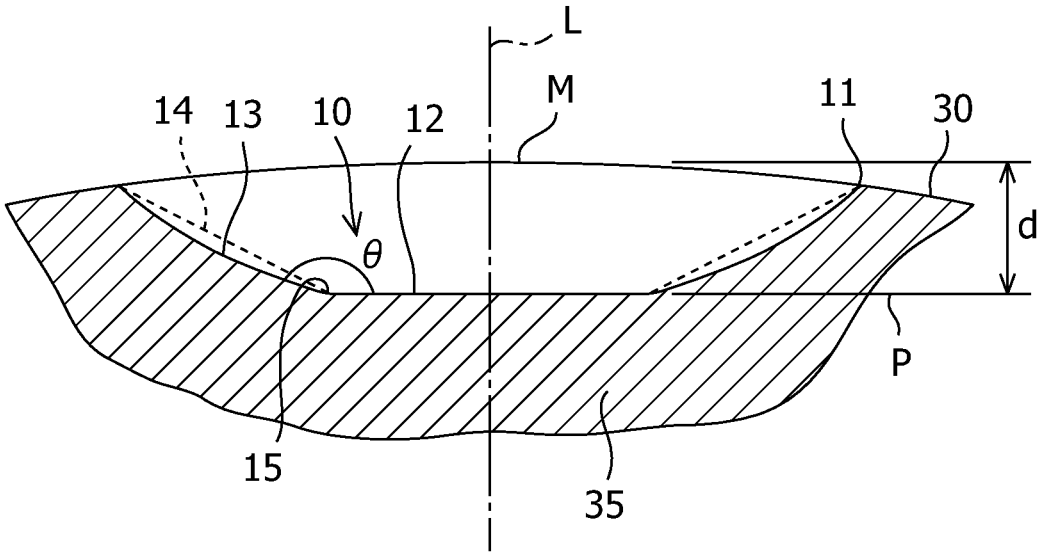
FIG. 2 is a partial sectional view of the golf ball shown FIG. 1, taken along the line A-A.

An embodiment of a golf ball in accordance with the present invention will now be described with reference to the accompanying drawings. FIG. 1 is an enlarged plan view showing the surface of a golf ball in accordance with one embodiment of the present invention, and FIG. 2 is a partial sectional view of the golf ball shown in FIG. 1, taken along the line A-A.

As shown in FIG. 1, plural dimples are formed on the surface of the golf ball of this embodiment. As these dimples, noncircular dimples 10 and circular dimples 20 are formed.

On the golf ball surface, a part in which the dimples are not formed is called a land part 30. The noncircular dimple 10 is defined as a dimple having a streamline shaped such that an outermost border line 11, which is a boundary line between the land part 30 and the noncircular dimple 10, comprises a curved line part and a straight line part. The circular dimple is defined as a dimple having a circular outermost border line.

In this embodiment, as shown in FIG. 1, one circular dimple is surrounded by five noncircular dimples, and therefore the circular dimples 20 are not adjacent to each other. The outermost border line 11 of the noncircular dimple 10 includes curved line parts 11*a* adjacent to the circular dimples 20 and straight line parts 11*b* adjacent to other noncircular dimples 10. The curved line part 11*a* of the outermost border line of the noncircular dimple 10 has an arcuate shape concentric with an outermost border line 21 of the circular dimple 20.

The curved line part 11*a* and the straight line part 11*b* are connected to each other with a part R, which has a shape of an arc of a circle (indicated by a broken line in FIG. 1) having a radius r. If the corner part of the noncircular dimple 10 has an angular shape, the resistance that the golf ball receives during flight increases. In contrast, if the corner part R is rounded as in this embodiment, the resistance is kept from increasing, by which the carry can be improved. The radius r of the corner part R is preferably about 0.1 mm or more, and more preferably about 0.3 mm or more. If the radius r is less than about 0.1 mm, the air resistance of the ball tends to increase. On the other hand, the radius r is preferably about 5 mm or less, and more preferably about 3 mm or less. If the radius r exceeds about 5 mm, the dimple shape differs greatly from the intended dimple shape, and the appearance is adversely affected.

On the surface of golf ball, the land part 30, in which the dimples are not formed, includes straight shaped land parts 31 arranged between the noncircular dimples 10 and arc shaped land parts 32 arranged between the noncircular dimple 10 and the circular dimple 20. One straight line shaped land part 31 and two arc shaped land parts 32 are connected in a trifurcate form.

As shown in FIG. 2, the noncircular dimple 10 has a flat bottom surface 12, not a bottom surface curved concentrically with respect to the golf ball surface. Also, the noncircular dimple 10 has a wall surface 13 between the bottom surface 12 and the land part 30. The boundary line between the bottom surface 12 and the wall surface 13 is called a bottom surface border line 15. The wall surface 13 may be a surface 14 (indicated by a broken line in FIG. 2) connecting the bottom surface border line 15 to the outermost border line 11 through the shortest distance. In this embodiment, however, as shown in FIG. 2, the wall surface 13 has a shape curved so as to be convex to the outside from the surface 14.

In the case in which the wall surface 13 is made the surface 14 having the shortest distance, the calculation and change of dimple volume can be made easily. In the case in which the wall surface 13 has a curved shape, the depth of the dimple can be made shallower, and a volume sufficient for a dimple can be obtained. The angle θ that the wall surface 13 forms with the bottom surface 12 is preferably 90 degrees or more, and more preferably about 100 degrees or more. Also, the angle θ is preferably 180 degrees or less. In the case in which the angle θ is 180 degrees, the dimple 10 is configured without the wall surface 13.

When a line drawn vertically from a surface M of an imaginary sphere of the golf ball surrounded by the outermost border line 11 to a plane that is the same as the bottom surface 12 of the dimple 10 is longest, this vertical line is taken as a centerline L. The position of the bottom surface 12 is preferably arranged with respect to the outermost border line 11 of the dimple so that this centerline intersects the bottom surface 12.

The depth d of the noncircular dimple 10 is defined as a distance on the centerline L from the surface M of the imaginary sphere to the plane that is the same as the bottom surface 12. The dimple depth d is preferably about 0.05 mm or more, and more preferably about 0.10 mm or more. Also, the dimple depth d is preferably about 0.40 mm or less, preferably about 0.30 mm or less, and still more preferably about 0.25 mm or less. The shape of the bottom surface of the circular dimple 20 may be a conventional curved shape such that the center is depressed. The depth of the circular dimple 20 at a position at which the dimple is deepest is preferably, for example, about 0.05 mm or more, further preferably about 0.10 mm or more, and on the other hand, is preferably about 0.45 mm or less, further preferably about 0.35 mm or less.

The position of the bottom surface 12 is preferably arranged so that the distance between the outermost border line 11 and the bottom surface border line 15 is equal at any position of the outer periphery of the noncircular dimple 10, that is, the bottom surface border line 15 is approximately similar to the outermost border line 11. The dimples can thereby be arranged more flexibly.

Figure 3:
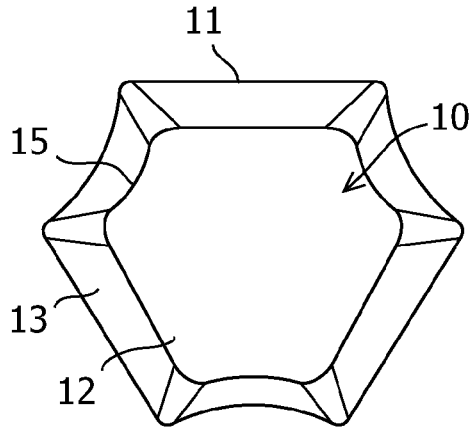
FIG. 3 is a plan view showing one embodiment of a noncircular dimple in accordance with the present invention.
Figure 4:
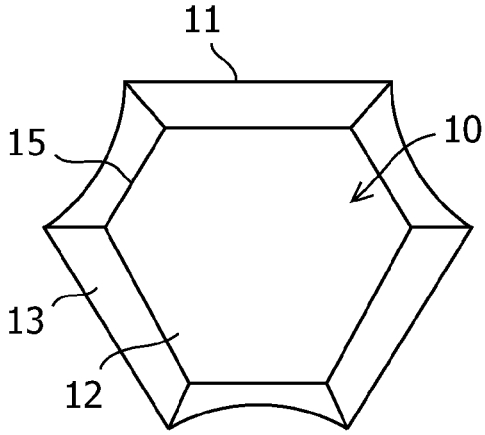
FIG. 4 is a plan view showing one embodiment of a noncircular dimple in accordance with the present invention.
Figure 5:
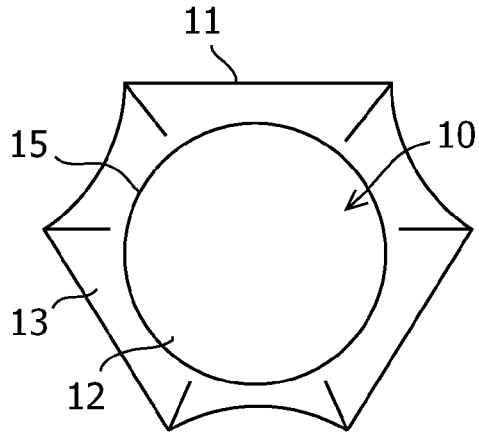
FIG. 5 is a plan view showing one embodiment of a noncircular dimple in accordance with the present invention.

The shape of the bottom surface 12 is not subject to any special limitation. The shape may be such that the bottom surface border line 15 is approximately similar to the outermost border line 11 as shown in FIG. 3, may be a polygonal shape such as a hexagonal shape as shown in FIG. 4, or may be a circular shape as shown in FIG. 5. Among these shapes, the shape as shown in FIG. 3 is especially preferable. By making the bottom surface border line 15 approximately similar to the outermost border line 11, the distance from the bottom surface 12 can be kept proper. Therefore, even if the dimple depth is decreased, a volume sufficient for a dimple can be obtained.

An area $S_2$ surrounded by the bottom surface border line 15 is preferably about 5% or more of an area $S_1$ surrounded by the outermost border line 11, further preferably about 20% or more thereof, and still further preferably about 50% or more thereof. By making the area $S_2$ of the bottom surface border line 15 about 5% or more of the area $S_1$ of the outermost border line 11, the volume of the dimple can be handled as a separate parameter. Also, the area $S_2$ of the bottom surface border line 15 is preferably 100% or less of the area $S_1$ of the outermost border line 11, and more preferably about 95% or less thereof. By making the area $S_2$ of the bottom surface border line 15 about 100% or less of the area $S_1$ of the outermost border line 11, ideal aerodynamic performance and good appearance can be obtained. The area $S_1$ surrounded by the outermost border line 11 is calculated as the area of a circle by simulating the length of the outermost border line 11 as the circumferential length of a circle on a plane. Similarly, the area $S_2$ surrounded by the bottom surface border line 15 is calculated as the area of a circle by simulating the length of the bottom surface border line 15 as the circumferential length of a circle on a plane.

The length of the outermost border line 11 is preferably about 3 mm or more, further preferably about 6 mm or more, and still further preferably about 9 mm or more. Also, the length of the outermost border line 11 is preferably about 22 mm or less, preferably about 19 mm or less, and still further preferably about 17 mm or less. The length of the outermost border line 11 made in the above-described range is sometimes effective in continuing the lift in the latter half of the trajectory.

The above-described noncircular dimples 10 each having the outermost border line consisting of the curved line parts and the straight line parts are preferably designed in the same way for one golf ball. However, since the golf ball has a spherical shape, it is difficult to design all noncircular dimples in the same way. Therefore, one golf ball sometimes includes similarly designed noncircular dimples subjected to some deformation. In addition, the circular dimple 20 may have a flat bottom surface. Specifically, the circular dimple 20 may has the same structures of the flat bottom and the wall surface as the noncircular dimple 10.

The golf ball in accordance with the present invention is not limited to the embodiment shown in FIG. 1, and can be configured by only the noncircular dimples each having the outermost border line consisting of the curved line parts and the straight line parts. Also, as a dimple capable of being combined with the noncircular dimple having the outermost border line consisting of the curved line parts and the straight line parts, in addition to the circular dimple shown in FIG. 1, dimples each having an elliptical shape, a polygonal shape, a dewdrop shape, and the like shape can be adopted. By combining a plurality of kinds of dimples, the dimples can be made multifunctional.

In the case in which plural kinds of dimples are formed on a golf ball, the ratio of the noncircular dimples each having the outermost border line consisting of the curved line parts and the straight line parts to all dimples is preferably about 10% or more, further preferably about 30% or more, and still further preferably about 40% or more. In the case in which the ratio of the noncircular dimples is as low as less than about 10%, a proper lift cannot be obtained, so that the carry cannot be increased. On the other hand, the ratio of the noncircular dimples to all dimples is preferably 100% or lower, further preferably about 80% or lower.

The ratio of the dimple surface to the imaginary spherical surface of golf ball, that is, the surface occupancy ratio of dimples is preferably about 65% or more, further preferably about 75% or more, and still further preferably about 85% or more. By making the surface occupancy ratio of dimples about 65% or more, the air resistance can be decreased. On the other hand, the surface occupancy ratio of dimples is preferably 100% or less.

The ratio of the dimple volume to the imaginary spherical volume of the golf ball, that is, the volume occupancy ratio of dimples, is preferably about 0.9% or more, more preferably about 1.0% or more, and still more preferably about 1.1% or more. On the other hand, the volume occupancy ratio of dimples is preferably about 2.0% or less, more preferably about 1.9% or less, and still more preferably about 1.8% or less. By making the volume occupancy ratio of dimples in the above-described range, a stable trajectory can be obtained.

The total volume of dimples formed on the surface of golf ball is preferably about 400 $mm^3$ or more, and more preferably about 500 $mm^3$ or more. On the other hand, the total volume of dimples is preferably about 800 $mm^3$ or less, and more preferably about 700 $mm^3$ or less. By making the total volume of dimples in the above-described range, an ideal trajectory can be obtained.

The total number of dimples formed on the surface of the golf ball is preferably about 50 or more, more preferably about 200 or more, still more preferably about 250 or more, and yet more preferably about 300 or more. On the other hand, the total number of dimples is preferably about 500 or fewer, more preferably about 400 or fewer, and still more preferably about 360 or fewer.

The construction of the golf ball may be a one-piece ball, or it may be a multiple-piece ball consisting of two or more pieces. In particular, the dimple of the present invention can be used more effectively for a multiple-piece golf ball providing a low spin. To obtain a golf ball that provides a long carry, is not affected by wind, and provides a long run in the case in which a golf ball is hit by using a golf club for long carry, such as a No. 1 wood (driver), the balance between the lift and the drag on the ball that has been hit must be proper. This balance between the lift and the drag of the ball that has been hit depends on the construction and material used of the golf ball, and in particular, on the kind, the number, the surface occupancy ratio, the total volume, and the like of the dimples formed.

A force acting on a golf ball is expressed by the following ballistic equation:

$$F=FL+FD+Mg \quad (1)$$

where, FL is lift, FD is drag, and Mg is gravity.

Also, the lift FL and the drag FD in ballistic equation (1) are expressed by the following equations (2) and (3), respectively.

$$FL=0.5\times CL\times\rho\times A\times V^2 \quad (2)$$

$$FD=0.5\times CD\times\rho\times A\times V^2 \quad (3)$$

where, CL is lift coefficient, CD is drag coefficient, p is air density, A is the maximum cross-sectional area of golf ball, and V is the speed in air of the golf ball.

To improve the carry, the drag coefficient CD in a high speed condition should be low, and the drag coefficient CL in a low speed condition should be high. More specifically, by arranging the noncircular dimples of the present invention, the lift coefficient CL at Re 70000/2000 rpm is preferably about 70% or more, and more preferably about 75% or more, of the lift coefficient CL at Re 80000/2000 rpm. In the case in which this CL ratio is lower than 70%, the lift FL in a low-speed region cannot be obtained properly, so the carry of the ball that has been hit sometimes cannot be obtained sufficiently.

Also, by arranging the noncircular dimples of the present invention, the drag coefficient CD at Re 180000/2520 rpm is preferably made about 0.225 or less, and more preferably about 0.220 or less. In the case in which the drag coefficient CD is greater than about 0.225, the carry of the ball having been hit sometimes cannot be obtained sufficiently. The decrease in only the drag FD or the drag coefficient CD hardly achieves an effect. The reason for this is that in the case in which only the drag coefficient CD is decreased, although the position of the highest point of the ball having been hit is distant, in the low-speed region after the highest point, there is a tendency for the carry of the ball that has been hit to be lost by a drop caused by the shortage of the lift FL.

The golf ball in accordance with the present invention can be manufactured by using a die. In preparing such a die, 3D CAD or CAM is used, and a method in which the shape of the entire surface is three-dimensionally cut directly in the reversing master die or a method in which the cavity parts of the molding die are cut three-dimensionally directly can be used. By designing the die so that the parting line of the die passes through the land part of golf ball surface, the trimming operation can be made easy. Also, to develop the land part evenly on the spherical surface of golf ball, it is preferable that an arranging method of a polyhedron such as an icosahedron, dodecahedron, and octahedron, with three symmetries, five symmetries, and the like be used.

Example

Figure 6:
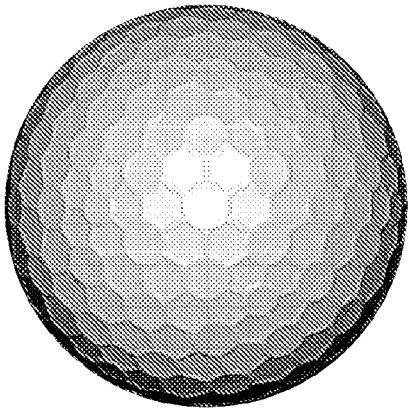
FIG. 6 is a photograph showing a golf ball of example 1.

As example 1, a golf ball shown in the photograph of FIG. 6 was manufactured. First, the calculation of the area ratio of a typical noncircular dimple of this golf ball is explained. In this typical noncircular dimple, the bottom surface border line and the outermost border line were similar. The length of the outermost border line was 15.61 mm, and the length of the bottom surface border line was 12.19 mm. In this case, since the area $S_1$ surrounded by the outermost border line is 19.39 $mm^2$, and the area $S_2$ surrounded by the bottom surface border line is 11.82 $mm^2$, the area ratio ($S_2/S_1$) is 61.0%. These typical noncircular dimples and noncircular dimples that were similar to the typical ones were formed in the number of 216, and circular dimples were formed in the number of 110. The surface occupancy ratio of dimples was set at 90%, the volume occupancy ratio of dimples at 1.68%, and the total volume of dimples at 683.2 $mm^3$. The carry at the time when the golf ball of example 1 was hit under the conditions that the head speed was 45 m/s, the delivery angle was 10 degrees, and the spin was 2800 rpm was measured. The results are given in Table 1.

Also, a golf ball of example 2 in which the bottom surfaces of circular and noncircular dimples were flat was manufactured. As comparative examples, golf balls of comparative examples 1 to 3, in which noncircular dimples the bottom surfaces of which were not flat, and circular dimples were combined, and a golf ball of comparative example 4 in which only circular dimples were formed were manufactured. Furthermore, a golf ball of comparative example 5 in which the bottom surfaces of circular dimples were flat, but the bottom surfaces of noncircular dimples were not flat was manufactured. For these golf balls as well, the carry was measured under the same conditions. The photographs of golf balls of comparative examples 1 to 4 are shown in FIGS. 7 to 10. The photographs of golf balls of example 2 and comparative example 5 are shown in FIGS. 11 and 12. Also, the design conditions and results of these golf balls are given in Table 1. The depth of noncircular dimple given in Table 1 is the average value of the noncircular dimples of the golf ball. Also, the average lengths of the outermost border lines of noncircular dimples of the golf balls of comparative examples 1 to 3 were 14.71 mm, 13.50 mm, and 16.16 mm, respectively. The low-velocity CL ratio was determined by calculating the ratio of the coefficient of life CL at a Reynolds number of 70,000 and a spin rate of 2,000 rpm to the coefficient of lift CL at a Reynolds number of 80,000 and a spin rate of 2,000 rpm from the ball's trajectory when the ball was launched using an Ultra Ball Launcher (UBL), which is available from Automated Design Corporation. The UBL is an apparatus having two pairs of drums, top and bottom, the top and bottom pairs of drums having belts wound therearound, a ball being inserted therebetween, and launched under desired conditions. The high-velocity CD was similarly obtained by measuring the drag coefficient for the ball when launched at a Reynolds number of 180,000 and a spin rate of 2,520 rpm.

TABLE 1

Figure 7:
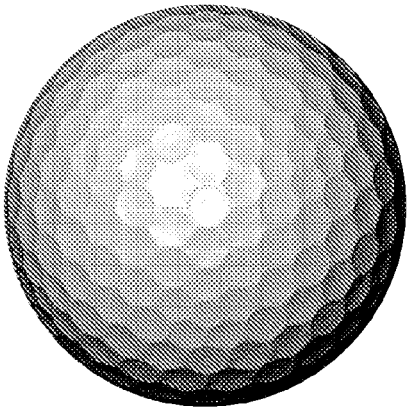
FIG. 7 is a photograph showing a golf ball of comparative example 1.
Figure 8:
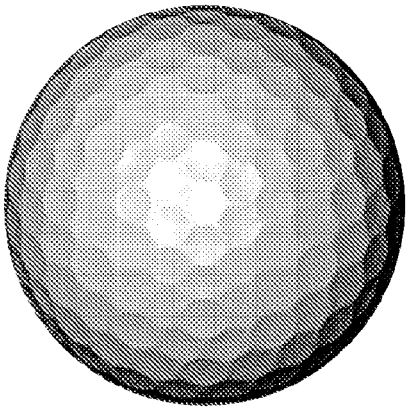
FIG. 8 is a photograph showing a golf ball of comparative example 2.
Figure 9:
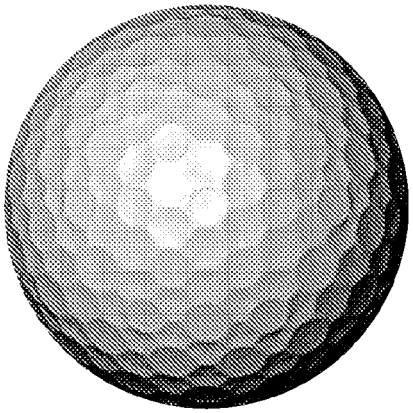
FIG. 9 is a photograph showing a golf ball of comparative example 3.
Figure 10:
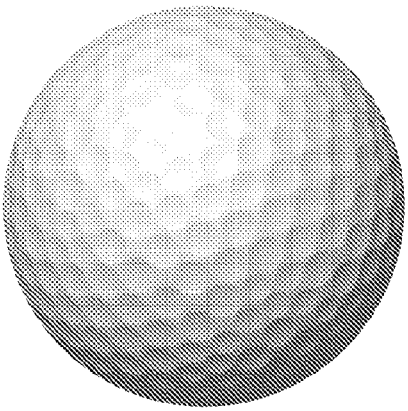
FIG. 10 is a photograph showing a golf ball of comparative example 4.
Figure 11:
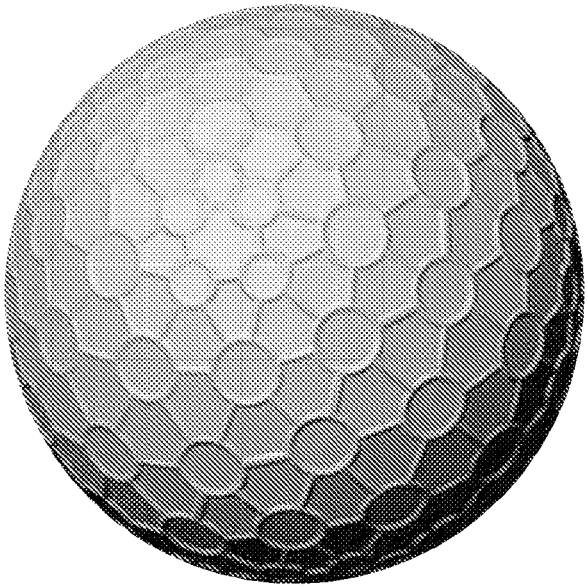
FIG. 11 is a photograph showing a golf ball of example 2.
Figure 12:
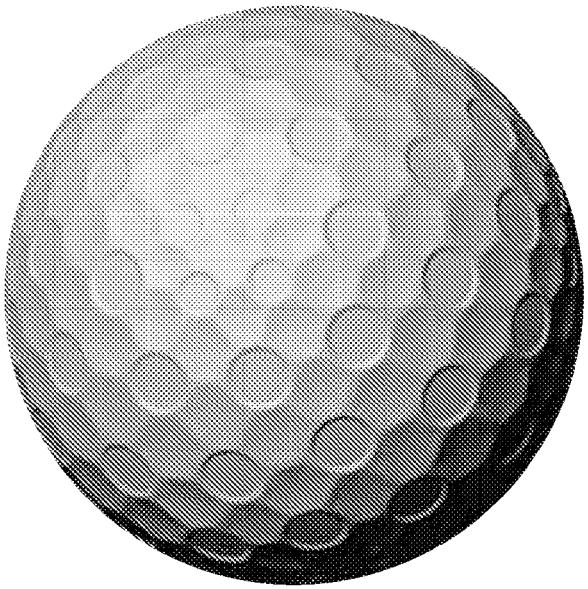
FIG. 12 is a photograph showing a golf ball of comparative example 5.

| | | Examples | | Comparative examples | | | | |
|---|---|---|---|---|---|---|---|---|
| | | 1 | 2 | 1 | 2 | 3 | 4 | 5 |
| Arrangement of dimples | | FIG. 6 | FIG. 11 | FIG. 7 | FIG. 8 | FIG. 9 | FIG. 10 | FIG. 12 |
| Number of dimples | Circular | 110 | 104 | 110 | 92 | 116 | 392 | 104 |
| | Noncircular | 216 | 198 | 216 | 180 | 240 | 0 | 198 |
| | Total | 326 | 302 | 326 | 272 | 356 | 392 | 302 |
| Ratio of noncircular dimples (%) | | 66.26 | 65.56 | 66.26 | 66.18 | 67.42 | — | 65.56 |
| Average depth of noncircular dimples (mm) | | 0.217 | 0.219 | 0.29 | 0.27 | 0.277 | — | 0.269 |
| Surface occupancy ratio of dimples (%) | | 90 | 88 | 90 | 88 | 85 | 76 | 88 |
| Volume occupancy ratio of dimples (%) | | 1.68 | 1.69 | 1.68 | 1.68 | 1.68 | 1.27 | 1.69 |
| Total volume of dimples ($mm^3$) | | 683.2 | 690.5 | 683.2 | 683.6 | 684.6 | 516.9 | 690.4 |
| Carry (m) | | 214.1 | 214.5 | 213.1 | 214.6 | 211.4 | 210.2 | 212.2 |
| Total (m) | | 225.8 | 226.2 | 223.7 | 224.3 | 222.8 | 220.5 | 223.5 |
| High-velocity CD | | 0.163 | 0.158 | 0.166 | 0.172 | 0.176 | 0.228 | 0.162 |
| Low-velocity CL ratio | | 76 | 77 | 73 | 75 | 69 | 66 | 76 |

As seen from Table 1, for the golf ball of example 1 in which the bottom surfaces of the noncircular dimples were flat, the carry increased about 1 m, and the total increased about 2 m, compared with the golf ball of comparative example 1 in which the bottom surfaces of the noncircular dimples were not flat. Although the arrangement of noncircular dimples in which the bottom surface was not flat and circular dimples was changed, as shown in comparative examples 2 and 3, the carry did not become longer than that of example 1. For the golf ball of comparative example 4 in which only the circular dimples were formed, the carry was shorter than that of any golf ball in which the noncircular dimples were combined.

Furthermore, for the golf ball of example 2 in which the bottom surfaces of the circular and noncircular dimples were flat, the carry increased about 2 m, and the total increased about 3 m, compared with the golf ball of comparative example 5 in which the bottom surfaces of the circular dimples were flat, but the bottom surfaces of the noncircular dimples were not flat.

What is claimed is:

1. A golf ball comprising:

a plurality of circular dimples formed on the surface thereof, each of the circular dimples having a flat bottom surface; and a plurality of noncircular dimples formed on the surface of the golf ball, at least about 10 percent of dimples of all the dimples on the surface being the noncircular dimples, wherein a boundary line between a land part of the golf ball and the noncircular dimples each comprise a curved line part and a straight line part, the plurality of noncircular dimples each having a flat bottom surface, the bottom surface of the noncircular dimple having a planar shape approximately similar to the boundary line.

2. The golf ball according to claim 1, wherein the curved line part and the straight line part in the boundary line of the noncircular dimple are connected to each other with a part having a smooth curvature.

3. The golf ball according to claim 1, wherein the surface occupancy ratio of the noncircular dimples to the surface of the golf ball is at least about 65 percent.

4. The golf ball according to claim 1, wherein at least about fifty noncircular dimples are formed.

5. The golf ball according to claim 1, wherein the lift coefficient CL at Re 70000/2000 rpm is at least about 70 percent of the lift coefficient CL at Re 80000/2000 rpm, and the drag coefficient CD at Re 180000/2520 rpm is up to about 0.225.

6. The golf ball according to claim 2, wherein the smooth curvature is an arc of a circle having a radius from about 0.1 to 3 mm.

7. The golf ball according to claim 1, wherein a wall surface of the noncircular dimples intersects the flat bottom surface at an angle ranging from about 100 to 180 degrees.

8. The golf ball according to claim 1, wherein the bottom surface has an area S2 from about 5 to 100% of an area S1 surrounded by the boundary line.

9. A golf ball comprising:

a plurality of circular dimples formed on the surface thereof, each of the circular dimples having a flat bottom surface; and a plurality of noncircular dimples formed on the surface of the golf ball, at least about 10 percent of dimples of all the dimples on the surface being the noncircular dimples, wherein a boundary line between a land part of the golf ball and the noncircular dimples each comprise a curved line part and a straight line part, the plurality of noncircular dimples each having a flat bottom surface, wherein the lift coefficient CL at Re 70000/2000 rpm is at least about 70 percent of the lift coefficient CL at Re 80000/2000 rpm, and the drag coefficient CD at Re 180000/2520 rpm is up to about 0.225.

10. The golf ball according to claim 9, wherein the bottom surface of the noncircular dimple has a circular planar shape.

11. The golf ball according to claim 9, wherein the bottom surface of the noncircular dimple has a polygonal planar shape.

12. The golf ball according to claim 9, wherein the curved line part and the straight line part in the boundary line of the noncircular dimple are connected to each other with a part having a smooth curvature.

13. The golf ball according to claim 9, wherein the surface occupancy ratio of the noncircular dimples to the surface of the golf ball is at least about 65 percent.

14. The golf ball according to claim 1, wherein at least about fifty noncircular dimples are formed.

15. The golf ball according to claim 12, wherein the smooth curvature is an arc of a circle having a radius from about 0.1 to 3 mm.

16. The golf ball according to claim 9, wherein a wall surface of the noncircular dimples intersects the flat bottom surface at an angle ranging from about 100 to 180 degrees.

17. The golf ball according to claim 9, wherein the bottom surface has an area S2 from about 5 to 100% of an area S1 surrounded by the boundary line.

* * * * *